US005858951A

United States Patent [19]

Ip et al.

[11] Patent Number: 5,858,951

[45] Date of Patent: Jan. 12, 1999

[54] CLEAR, HOMOGENEOUS AND TEMPERATURE-STABLE LIQUID LAUNDRY DETERGENT PRODUCT CONTAINING BLEND OF ANIONIC AND NONIONIC SURFACTANTS

[75] Inventors: John Ip, Princeton, N.J.; Charles D. Carr, Yardly, Pa.; Francis R. Cala, Highland Park, N.J.; Anthony J. Falotico, Doylestown, Pa.

[73] Assignee: Church & Dwight Co., Inc., Princeton, N.J.

[21] Appl. No.: 851,034

[22] Filed: May 5, 1997

[51] Int. Cl.[6] ..... C11D 1/68; C11D 1/83; C11D 3/08

[52] U.S. Cl. ..... 510/352; 510/351; 510/422; 510/424; 510/426; 510/428

[58] Field of Search ..... 510/303, 424, 510/351, 426, 421, 422, 352, 427, 428, 531, 509, 536

[56] References Cited

U.S. PATENT DOCUMENTS

| | | | |
|---|---|---|---|
| 4,265,790 | 5/1981 | Winston et al. | 252/532 |
| 4,464,292 | 8/1984 | Lengyel | 252/532 |
| 4,828,722 | 5/1989 | Steltenkamp | 510/328 |
| 4,842,767 | 6/1989 | Warschewski et al. | 510/321 |
| 5,073,292 | 12/1991 | Hessel et al. | 510/393 |

*Primary Examiner*—Paul Lieberman
*Assistant Examiner*—Necholus Ogden
*Attorney, Agent, or Firm*—Irving Fishman

[57] ABSTRACT

This invention provides a liquid laundry detergent product with freeze/thaw and high/low temperature stability. The detergent product is an aqueous medium having a content of sodium carbonate detergent builder, and a surfactant blend of specific amounts of two anionic salt compounds and two nonionic compounds of specific chemical structure.

15 Claims, No Drawings

CLEAR, HOMOGENEOUS AND TEMPERATURE-STABLE LIQUID LAUNDRY DETERGENT PRODUCT CONTAINING BLEND OF ANIONIC AND NONIONIC SURFACTANTS

BACKGROUND OF THE INVENTION

The present invention relates to liquid detergent products which are adapted for home laundry machine washing of fabrics. More specifically the present invention relates to heavy duty liquid laundry detergent products which exhibit superior freeze/thaw and high/low temperature stability.

Compared with powder-form detergents, liquid detergents have handling advantages and other performance features. In particular, larger quantities of nonionic surfactants can be incorporated in liquid detergents than in powder-form detergents, which has the advantage of greater effectiveness against oily and greasy soil.

A water-based liquid detergent which contains a mixture of anionic and nonionic surfactants, and in which the nonionic surfactant is 20% or more of the liquid detergent, generally lacks homogeneity and typically undergoes phase separation. As another disadvantage, liquid detergents of this type often exhibit a higher viscosity than is desirable for normal laundry usage.

Further to liquid laundry detergent compositions, the incorporation of a major amount of detergent builder poses a significant formulation challenge since the presence of a major quantity of detergent builder inevitably causes the detergent composition to phase separate. Liquid detergent formulations that contain a detergent builder ingredient require careful control of the surfactant to builder ratio so as to prevent salting-out of the surfactant phase.

In another aspect, liquid laundry detergent compositions are susceptible to instability under extended freeze/thaw and high/low temperature conditions.

A variety of improved types of liquid detergent compositions are described in publications such as U.S. Pats. No. 3,929,680; 4,092,273; 4,105,592; 4,110,262; 4,201,686; 4,368,147; 4,490,285; 4,671,895; 4,747,977; 5,049,302; 5,132,053; 5,205,960; 5,215,683; 5,403,516; 5,409,629; 5,500,151; 5,529,724; 5,536,440; and 5,597,507; incorporated by reference.

There remains a continuing interest in the development of improved liquid detergent compositions which overcome one or more inherent disadvantages associated with liquid detergent products.

Accordingly, it is an object of this invention to provide a heavy duty liquid detergent composition which contains a high level of active surfactant ingredients.

It is another object of this invention to provide a liquid laundry detergent product which has a content of detergent builder, and which has clarity and stability without the inclusion of a hydrotrope constituent.

It is a further object of this invention to provide a liquid laundry detergent product which provides high detergency under fabric washing conditions, and which exhibits freeze/thaw and high/low temperature stability.

Other objects and advantages of the present invention shall become apparent from the accompanying description and examples.

DESCRIPTION OF THE INVENTION

One or more objects of the present invention are accomplished by the provision of a liquid laundry detergent product with freeze/thaw and high/low temperature stability, which is an aqueous medium having a content comprising (1) between about 0.5–12 weight percent of sodium carbonate detergent builder ingredient; and (2) between about 5–35 weight percent of a detergent active ingredient which is a surfactant blend comprising (a) between about 15–55 weight percent, based on the surfactant weight, of an anionic salt compound corresponding to the formula:

$$R—O—(CH_2CH_2O)_3—SO_3M$$

where R is a $C_{10}$–$C_{16}$ alkyl group, and M is an alkali metal or ammonium cation, (b) between about 15–55 weight percent, based on the surfactant weight, of an anionic salt compound corresponding to the formula:

$$R—O—(CH_2CH_2O)_7—SO_3M$$

where R is a $C_{10}$–$C_{16}$ alkyl group, and M is an alkali metal or ammonium cation, (c) between about 15–55 weight percent, based on the surfactant weight, of a nonionic compound corresponding to the formula:

$$R—O—(CH_2CH_2O)_3—H$$

where R is a $C_{10}$–$C_{16}$ alkyl group, and (d) between about 15–55 weight percent, based on the surfactant weight, of a nonionic compound corresponding to the formula:

$$R—O—(CH_2CH_2O)_7—H$$

where R is a $C_{10}$–$C_{16}$ alkyl group.

In another embodiment this invention provides a detergent active composition which is a surfactant blend comprising (a) between about 15–55 weight percent of an anionic salt compound corresponding to the formula:

$$R—O—(CH_2CH_2O)_3—SO_3M$$

where R is a $C_{10}$–$C_{16}$ alkyl group, and M is an alkali metal or ammonium cation, (b) between about 15–55 weight percent of an anionic salt compound corresponding to the formula:

$$R—O—(CH_2CH_2O)_7—SO_3M$$

where R is a $C_{10}$–$C_{16}$ alkyl group, and M is an alkali metal or ammonium cation, (c) between about 15–55 weight percent of a nonionic compound corresponding to the formula:

$$R—O—(CH_2CH_2O)_3—H$$

where R is a $C_{10}$–$C_{16}$ alkyl group, and (d) between about 15–55 weight percent of a nonionic compound corresponding to the formula:

$$R—O—(CH_2CH_2O)_7—H$$

where R is a $C_{10}$–$C_{16}$ alkyl group.

As described more fully hereinafter, a present invention liquid laundry detergent product is a clear homogeneous aqueous solution which is stable under freeze/thaw and high/low temperature conditions, and which provides high detergency when utilized in home laundry machine washing of fabrics.

A present liquid laundry detergent product does not include any non-detergent solubilizer or hydrotrope to achieve clarity and stability. A specific combination of specific surfactant and detergent builder ingredients is an essential aspect of the present invention.

Suitable water-soluble detergent builder compounds for a present invention liquid laundry detergent product as defined herein include alkali metal and ammonium carbonates, bicarbonates, sesquicarbonates, silicates, phosphates, orthophosphates, pyrophosphates, tripolyphosphates, borates, and the like. Sodium and potassium carbonates, bicarbonates and sesquicarbonates are illustrative of preferred types of inorganic salt detergent builder compounds.

A present invention laundry detergent product can contain other optional detergent adjuncts, which include lather boosters such as alkanolamines, lather depressants such as alkyl phosphates or silicones, anti-redeposition agents such as sodium polycarboxylate, oxygen-releasing bleaching agents such as sodium perborate or sodium percarbonate, fabric softening agents, fluorescent agents, perfumes, enzymes, germicides, colorants, and the like.

A preferred type of anti-redeposition agent is sodium polyacrylate having a molecular weight of 2000–50,000.

It is generally desirable to include between about 1–15 weight percent of sodium or potassium silicate ingredient in the liquid laundry detergent product to provide buffering capacity and to prevent corrosion of metal parts in washing machines.

The novel detergent active surfactant blend ingredient of a present invention laundry detergent product is prepared by a partial sulfation procedure similar to that described in U.S. Pat. No. 4,464,292, incorporated by reference.

In a typical sulfation procedure, a selected nonionic ethoxylated alcohol mixture is admixed with 96–100% concentrated sulfuric acid, in a proportion of about 0.5–2 moles of sulfuric acid per mole of nonionic ethoxylated alcohol mixture. The exothermic reaction admixture is maintained at a temperature between about 90°–150° F. for a sufficient period between about 0.5–45 minutes to convert about 30–80 weight percent of the initial ethoxylated alcohol mixture to a sulfate ester derivative.

The resulting partially sulfated nonionic ethoxylated alcohol blend is a liquid mixture of residual unsulfated ethoxylated alcohols, and sulfated ethoxylated alcohols, and lesser quantities of residual unsulfated unethoxylated alcohols, and sulfated unethoxylated alcohols.

A commercial nonionic ethoxylated alcohol product such as Neodol 23-3 is composed of a liquid mixture of $C_{12}$–$C_{13}$ alcohols which have an average content of three ethoxylate groups per alcohol molecule. A commercial nonionic ethoxylated alcohol product such as Neodol 23-3 typically has a content of up to about 20 weight percent of unethoxylated alcohols such as $C_{12}$–$C_{13}$ alcohols. Nominally 24-3 refers to a mixture of $C_{12}$–$C_{14}$ alcohols which have an average content of three ethoxylate groups per alcohol molecule, and 26-7 refers to a mixture of $C_{12}$–$C_{16}$ alcohols which have an average content of seven ethoxylate groups per alcohol molecule.

The blend of partially sulfated nonionic ethoxylated alcohol constituents is neutralized with a basic reagent such as alkali metal hydroxide or carbonate.

The superior stability and detergency properties of a present invention liquid laundry detergent product mainly are attributable to the content of the partially sulfated and neutralized anionic/nonionic surfactant blend which has the specifications described herein. The inclusion of a detergent builder provides further enhancement of the detergency properties.

The following examples are further illustrative of the present invention. The components and specific ingredients are presented as being typical, and various modifications can be derived in view of the foregoing disclosure within the scope of the invention.

A Standard Wash Test for detergency performance by instrumental evaluation of soiled swatches washed with a detergent formulation in a washing machine is conducted with the following equipment and procedures.

Equipment And Materials

Super Capacity Whirlpool Washers
Dryers
Balance
BYK Gardner Color View Spectrophotometer
Laundry Marker
Tagger Tail Fastener and Tag Attacher
Stock Ca/Mg Hardness Solution (2:1 & 3:1)
Test Products
Pillow Case Ballast
Stripping Detergent
Clorox Bleach
Titration Apparatus
Titrant (Sodium(di) Ethylenediamine Tetraacetate)
Indicator (Eriochrome Black T Solution)

Standard Test Swatches Per Treatment

| Number | | Supplier |
|---|---|---|
| | SOIL SWATCHES | |
| 4 | Standard Soil on Cotton | Test Fabrics |
| 4 | Dust Sebum on Cotton | Scientific Services |
| 4 | Clay on Cotton | Scientific Services |
| 4 | Dust Sebum on Poly/Cotton | Scientific Services |
| 4 | Clay on Poly/Cotton | Scientific Services |
| | STAIN SWATCHES | |
| 4 | Beef Gravy on Cotton | Scientific Services |
| 4 | Ketchup on Cotton | Scientific Services |
| 4 | Coffee on Cotton | Scientific Services |
| 4 | Grass on Cotton | Scientific Services |
| | WHITENESS SWATCHES | |
| 4 | Merc. Combed Broadcloth 100% Cotton S419 | Test Fabrics |

The four swatches are split for duplicate machine treatments.

Test Conditions

| | |
|---|---|
| Screening Condition: | 95° F. 100 ppm |
| Standard Conditions: | 68° F., 95° F., 122° F. 100 ppm, 250 ppm |

Preparation

1. STD swatches are labeled on side where stain is applied.
2. Measurements for soiled and whiteness swatches are taken using spectral software program.
3. For each test product labeled, soiled and whiteness swatches are attached to pillowcases. There are four pillowcases with swatches attached for each treatment. Two pillowcases are put in one washer and the other two are put in a duplicate washer.
4. 5 lbs of pillowcase ballast are weighed out, 2 sets per treatment.
5. Washers are run through one wash cycle to rinse washers.

6. Amount of hardness solution (for 100 ppm or below, 3:1 hardness stock used; for over 100 ppm 2:1 hardness solution used) to add to washer is determined. Desired hardness for each washer for wash and rinse cycles is measured out.

Condensed Titration Procedure

A. Sample needed to use 10–15 ml titrant estimated.

B. Water is added to 250 erlenmeyer flask and sample is weighed.

C. 2 ml buffer solution is added.

D. 4 drops of indicator are added.

E. Titration with EDTA solution is conducted until blue end-point is reached.

$$\text{Hardness} = \frac{\text{ml of titrate factor}^* \times 1000}{\text{weight of sample}}$$

* Titrate factor is listed on buret.

7. Washer to be used for each treatment and duplicate sets are randomly selected.

Wash Procedure

1. Super capacity whirlpool machines are set on medium load, hot water setting. The machines are started and the temperatures are adjusted. Starting with the first washer, agitate, then add water hardness solution and detergent. Test load and pillowcases with labeled swatches attached and randomly added. The machine is set for 14 minutes. The washer is started, and agitation is timed for 12 minutes.
2. Each washer is set for the same fast spin time (7 minutes).
3. After 12 minutes have elapsed, the washer is turned off, and the rinse/spin cycle is started.
4. After washer has filled for rinse and starts to agitate, measured hardness solution is added to water, and the washer is allowed to complete cycles.
5. The pillowcases with swatches attached are removed from the washer, and dried on medium to high setting in dryer.
6. The ballast is stripped in large industrial washers, with 1 scoop of stripping detergent and 1 cup of bleach on hot setting. The cycle is repeated with 1 cup of bleach. The ballast is dried in industrial dryer on medium setting for about 30 minutes.
7. When pillowcases with swatches are dry, the swatches are removed. The swatches are read on the colorview. Swatches are read on the labeled side and in the same position on colorview orifice as initial readings.

Calculations

1. Stain and soil removal as % SR(E):

$$\%\,SR(E) = \frac{E_i - E_f}{E_i} \times 100$$

Prewash:

$$E_i = [(L_u - L_o)^2 + (a_u a_o)^2 + (b_u - b_o)^2]^{1/2}$$

Postwash:

$$E_f = [L_w - L_o]^2 + (a_w - a_o)^2 + (b_w - b_o)^2]^{1/2}$$

u=unwashed stained swatch
w=washed stained swatch
o=unwashed unstained swatch

2. Whiteness

Initial swatch readings UV Filter out—UV Filter in—Initial B and Initial WIE

Final Swatch readings UV Filter out—UV Filter in—Final B and Final WIE

Initial B or WIE—Final B or WIE=Delta B or WIE

3. Statistical Method to yield the LSD (least significant difference) at the 95% confidence level for treatment comparison is calculated using StatGraphics program, with anova analysis of variance, multiple range test.

EXAMPLE I

This Example illustrates the stability of surfactant mixtures in aqueous media under freeze/thaw and high/low temperature conditions.

TEST A—Stability of Nonionics and Soda Ash in Water

Test batches are prepared by admixing in order deionized water (DI), ethoxylated alcohol (EA) and 10% soda ash premix.

Test Factors freeze/thaw 3 cycles

RT 2 weeks

122° C. 2 weeks refrigerator 2 weeks

| Test | DI water (g) | 23–3 (g) | 24–4.3 (g) | 26–7 (g) | soda ash premix (g) |
|---|---|---|---|---|---|
| A | 700.00 | — | — | — | 300.00 |
| B | 823.08 | 176.92 | — | — | — |
| C | 823.08 | — | 176.92 | — | — |
| D | 823.08 | — | — | 176.92 | — |
| E | 523.08 | 176.92 | — | — | 300.00 |
| F | 523.08 | — | 176.92 | — | 300.00 |
| G | 523.08 | — | — | 176.92 | 300.00 |

TABLE I

EA/ASH SAMPLE COMPOSITION

| | Test A 0 EA 0 MW | Test B 20.7 23-3 320 MW | Test C 20.7 24-4.3 394 MW |
|---|---|---|---|
| Formula | wt (g) | wt (g) | wt (g) |
| Premix (10%) | | | |
| water | 297.00 | 0.00 | 0.00 |
| dense ash | 33.00 | 0.00 | 0.00 |
| Main Mix | | | |
| water | 700.00 | 823.08 | 823.08 |
| EA | 0.00 | 176.92 | 176.92 |
| premix | 300.00 | 0.00 | 0.00 |
| water | 0.00 | 0.00 | 0.00 |
| | 1000.00 | 1000.00 | 1000.00 |

TABLE I-continued

| EA/ASH SAMPLE COMPOSITION | | |
|---|---|---|
| | Test D<br>20.7 26-7<br>487 MW | Test E<br>20.7 23-3<br>320 MW |
| Formula | wt (g) | wt (g) |
| Premix (10%) | | |
| water | 0.00 | 297.00 |
| dense ash | 0.00 | 33.00 |
| Main Mix | | |
| water | 823.08 | 523.08 |
| EA | 176.92 | 176.92 |
| premix | 0.00 | 300.00 |
| water | 0.00 | 0.00 |
| | 1000.00 | 1000.00 |
| | Test F<br>20.7 24-4.3<br>394 MW | Test G<br>20.7 26-7<br>487 MW |

TABLE I-continued

| EA/ASH SAMPLE COMPOSITION | | |
|---|---|---|
| Formula | wt (g) | wt (g) |
| Premix (10%) | | |
| water | 297.00 | 297.00 |
| dense ash | 33.00 | 33.00 |
| Main Mix | | |
| water | 523.08 | 523.08 |
| EA | 176.92 | 176.92 |
| premix | 300.00 | 300.00 |
| water | 0.00 | 0.00 |
| | 1000.00 | 1000.00 |

Batch size 1000 g
Sample size 117 g

TEST B—Stability of Ethoxylated Sulfates (ES) in Water

Test batches are prepared by admixing in order DI water, 50% caustic solution and anionic premix (ethoxy sulfate, ES). The admixture is adjusted to pH 7–9, and qs DI water to 1000 g.

| Test Factors | |
|---|---|
| freeze/thaw | 3 cycles |
| RT | 2 weeks |
| 122° C. | 2 weeks |
| refrigerator | 2 weeks |

ES PREMIX PREPARATION

The premixes are prepared at a reaction temperature below 130° F., and a minimum mix time of 10 minutes:

3/7 mole at 100/0 split—55.09 g 99.6% $H_2SO_4$ added slowly to 149.32 g 23-3 (MW 320)

3/7 mole at 75/25 split—51.05 g 99.6% $H_2SO_4$ added slowly to 113.51 g 23-3 and 37.84 g 26-7 (MW 487)

3/7 mole at 50/50 split—46.90 g 99.6% $H_2SO_4$ added slowly to 76.71 g 23-3 and 76.71 g 26-7

3/7 mole at 25/75 split—42.64 g 99.6% $H_2SO_4$ added slowly to 38.89 g 23-3 and 116.67 g 26-7

3/7 mole at 0/100 split—38.25 g 99.6% $H_2SO_4$ added slowly to 157.76 g 26-7

| | | | 3/7 mole ES | | | | |
|---|---|---|---|---|---|---|---|
| | DI water (g) | NaOH 50% (g) | 100/0 (g) | 75/25 (g) | 50/50 (g) | 25/75 | 0/100 |
| Test A | 727.65 | 67.94 | 204.41 | — | — | — | — |
| Test B | 734.65 | 62.95 | — | 202.40 | — | — | — |
| Test C | 741.84 | 57.83 | — | — | 200.33 | — | — |
| Test D | 749.23 | 52.57 | — | — | — | 198.20 | — |
| Test E | 756.83 | 47.16 | — | — | — | — | 196.01 |

TABLE II

| ES SAMPLE COMPOSITION | | | | |
|---|---|---|---|---|
| | Test A | | Test B | |
| | 23-3 | 26-7 | 23-3 | 26-7 |
| | 100% | 0% | 75% | 25% |
| EA (% batch) | 14.93% | 0.00% | 11.35% | 3.78% |
| Total (g/use) | 20.70 | | 20.70 | |
| Usage (g) | 117.0 | | 117.0 | |
| Formula | wt (g) | | wt (g) | |
| Premix (ES) | | | | |
| 23-3 | 149.32 | | 113.51 | |
| 26-7 | 0.00 | | 37.84 | |
| $H_2SO_4$ | 55.09 | | 51.05 | |
| Main Mix | | | | |
| water | 550.00 | | 550.00 | |
| NaOH, 50% | 67.94 | | 62.96 | |
| premix (ES) | 204.41 | | 202.40 | |
| water | 177.65 | | 184.65 | |
| | 1000.00 | | 1000.00 | |

TABLE II-continued

| ES SAMPLE COMPOSITION | Test C | | Test D | |
|---|---|---|---|---|
| | 23-3 | 26-7 | 23-3 | 26-7 |
| | 50% | 50% | 25% | 75% |
| EA (% batch) | 7.67% | 7.67% | 3.89% | 11.67% |
| Total (g/use) | 20.70 | | 20.70 | |
| Usage (g) | 117.0 | | 117.0 | |
| Formula | wt (g) | | wt (g) | |
| Premix (ES) | | | | |
| 23-3 | 76.71 | | 38.89 | |
| 26-7 | 76.71 | | 116.67 | |
| $H_2SO_4$ | 46.90 | | 42.64 | |
| Main Mix | | | | |
| water | 550.00 | | 550.00 | |
| NaOH, 50% | 57.84 | | 52.58 | |
| premix (ES) | 200.33 | | 198.20 | |
| water | 191.84 | | 199.23 | |
| | 1000.00 | | 1000.00 | |

| | Test E | |
|---|---|---|
| | 23-3 | 26-7 |
| | 0% | 100% |
| EA (% batch) | 0.00% | 15.78% |
| Total (g/use) | 20.70 | |
| Usage (g) | 117.0 | |
| Formula | wt (g) | |
| Premix (ES) | | |
| 23-3 | 0.00 | |
| 26-7 | 157.76 | |
| $H_2SO_4$ | 38.25 | |
| Main Mix | | |
| water | 550.00 | |
| NaOH, 50% | 47.17 | |
| premix (ES) | 196.01 | |
| water | 206.83 | |
| | 1000.00 | |

TEST C—Stability of ES/Soda Ash in Water

Test batches are prepared by admixing in order DI water, 50% caustic solution and ES premix. After the admixture is adjusted to pH 7–9, a 20% soda ash premix is added and qs DI water to 1000 g.

| Test Factors | |
|---|---|
| freeze/thaw | 3 cycles |
| RT | 2 weeks |
| 122° C. | 2 weeks |
| refrigerator | 2 weeks |

ES PREMIX PREPARATION

The premixes are prepared at a reaction temperature below 130° F., and a minimum mix time of 10 minutes:

3/7 mole at 100/0 split—55.09 g 99.6% $H_2SO_4$ added slowly to 149.32 g 23-3 (MW 320)

3/7 mole at 75/25 split—51.05 g 99.6% $H_2SO_4$ added slowly to 113.51 g 23-3 and 37.84 g 26-7 (MW 487)

3/7 mole at 50/50 split—46.90 g 99.6% $H_2SO_4$ added slowly to 76.71 g 23-3 and 76.71 g 26-7

3/7 mole at 25/75 split—42.64 g 99.6% $H_2SO_4$ added slowly to 38.89 g 23-3 and 116.67 g 26-7

3/7 mole at 0/100 split—38.25 g 99.6% $H_2SO_4$ added slowly to 157.76 g 26-7

| | DI water (g) | NaOH 50% (g) | soda ash mix (g) |
|---|---|---|---|
| Test A | 727.65 | 67.94 | 150.0 |
| Test B | 734.65 | 62.95 | 150.0 |
| Test C | 741.84 | 57.83 | 150.0 |
| Test D | 749.23 | 52.57 | 150.0 |
| Test E | 756.83 | 47.16 | 150.0 |

| | 3/7 mole ES | | | | |
|---|---|---|---|---|---|
| | 100/0 (g) | 75/25 (g) | 50/50 (g) | 25/75 (g) | 0/100 (g) |
| Test A | 204.41 | — | — | — | — |
| Test B | — | 202.40 | — | — | — |
| Test C | — | — | 200.33 | — | — |
| Test D | — | — | — | 198.20 | — |
| Test E | — | — | — | — | 196.01 |

TABLE III

| ES/ASH SAMPLE COMPOSITION | Test A | | Test B | |
|---|---|---|---|---|
| | 23-3 | 26-7 | 23-3 | 26-7 |
| | 100% | 0% | 75% | 25% |
| EA (% batch) | 14.93% | 0.00% | 11.35% | 3.78% |
| Total (g/use) | 20.10 | | 20.70 | |
| Usage (g) | 117.0 | | 117.0 | |
| Formula | wt (g) | | wt (g) | |
| Premix 1 (10%) | | | | |
| water | 120.00 | | 120.00 | |
| dense ash | 30.00 | | 30.00 | |
| Premix 2 (ES) | | | | |
| 23-3 | 149.32 | | 113.51 | |
| 26-7 | 0.00 | | 37.84 | |
| $H_2SO_4$ | 55.09 | | 51.05 | |
| Main Mix | | | | |
| water | 550.00 | | 550.00 | |
| NaOH, 50% | 67.94 | | 62.96 | |
| premix 2 | 204.41 | | 202.40 | |
| premix 1 | 150.00 | | 150.00 | |
| water | 27.65 | | 34.65 | |
| | 1000.00 | | 1000.00 | |

| | Test C | | Test D | |
|---|---|---|---|---|
| | 23-3 | 26-7 | 23-3 | 26-7 |
| | 50% | 50% | 25% | 75% |
| EA (% batch) | 7.67% | 7.67% | 3.89% | 11.67% |
| Total (g/use) | 20.70 | | 20.70 | |
| Usage (g) | 117.0 | | 117.0 | |
| Formula | wt (g) | | wt (g) | |
| Premix 1 (10%) | | | | |
| water | 120.00 | | 120.00 | |
| dense ash | 30.00 | | 30.00 | |
| Premix 2 (ES) | | | | |
| 23-3 | 76.71 | | 38.89 | |

TABLE III-continued

| | | |
|---|---|---|
| 26-7 | 76.71 | 116.67 |
| $H_2SO_4$ | 46.90 | 42.64 |
| Main Mix | | |
| water | 550.00 | 550.00 |
| NaOH, 50% | 57.84 | 52.58 |
| premix 2 | 200.33 | 198.20 |
| premix 1 | 150.00 | 150.00 |
| water | 41.84 | 49.23 |
| | 1000.00 | 1000.00 |

| | Test E | |
|---|---|---|
| | 23-3 | 26-7 |
| | 0% | 100% |
| EA (% batch) | 0.00% | 15.78% |
| Total (g/use) | 20.70 | |
| Usage (g) | 117.0 | |
| Formula | wt (g) | |
| Premix 1 (10%) | | |
| water | 120.00 | |
| dense ash | 30.00 | |
| Premix 2 (ES) | | |
| 23-3 | 0.00 | |
| 26-7 | 157.76 | |
| $H_2SO_4$ | 38.25 | |
| Main Mix | | |
| water | 550.00 | |
| NaOH, 50% | 47.17 | |
| premix 2 | 196.01 | |
| premix 1 | 150.00 | |
| water | 56.83 | |
| | 1000.00 | |

TEST RESULTS 1. freeze-thaw
2. room temperature
3. 122° F.
4. refrigerator

| TEST A Stability at 17 days | | | |
|---|---|---|---|
| 3% ash | 17.7% 3 EA | 17.7% 4.3 EA | 17.7% 7 EA |
| passed | $failed_{1,2,3,4}$ | $failed_{1,2,3,4}$ | $failed_{1,2,3,4}$ |

| | | |
|---|---|---|
| 3% ash + 17.7% 3 EA | 3% ash + 17.7% 4.3 EA | 3% ash + 17.7% 7 EA |
| $failed_1$ | $failed_{1,2,3,4}$ | $failed_{1,3}$ |

| TEST B Stability at 15 days | | |
|---|---|---|
| 17.7% ES 3–100%: 7–0% | 17.7% ES 3–75%: 7–25% | 17.7% ES 3–50%: 7–50% |
| failed | $failed_{1,2,3,4}$ | passed |

| | |
|---|---|
| 17.7% ES 3–25%: 7–75% | 17.7% ES 3–0%: 7–100% |
| passed | passed |

-continued

| TEST C Stability at 15 days | | |
|---|---|---|
| 3% ash + 17.7% ES 3–100%: 7–0% | 3% ash + 17.7% ES 3-75%: 7–25% | 3% ash + 17.7% ES 3–50%: 7–50% |
| $failed_{1,2,3,4}$ | $failed_3$ | passed |

| | |
|---|---|
| 3% ash + 17.7% ES 3–25%: 7–75% | 3% ash + 17.7% ES 3–0%: 7–100% |
| $failed_1$ | $failed_1$ |

The comparative data demonstrate that a specific blend of 3 ethoxy mole and 7 ethoxy mole ethoxylated alcohol and ethoxylated alcohol sulfate (50 weight % 3 mole/50 weight % 7 mole) passes 3 cycle freeze-thaw and 2 week high/low temperature stability tests when admixed with 3% soda ash in an aqueous medium.

EXAMPLE II

This Example illustrates the detergency properties of liquid formulations in accordance with the present invention.

Ethoxylated alcohol mixtures are sulfated to a 58% ES conversion level with a 1.2 molar excess of 99.6% sulfuric acid.

Different ethoxylated alcohol mixtures have different molar contents of ethoxy groups.

Textile swatches with different types of stains and soils are utilized.

STOCK SOLUTIONS

10% LAE solution 110 g Vista Alfonic 1216 MOD7 dissolved in 900 g distilled water to make a clear 10% solution 10% LAS solution 97.4 g Biosoft S-100 (96%; Stepan) neutralized with 50% NaOH to pH 7, qs with distilled water to 1000 g 10% AES solution 166.7 g Biosoft CS-460 (60%, Stepan) dissolved in 833.3 g distilled water to make a clear 10% solution

10% 23-3 ES a 120 g 58% converted ES prepared by mixing 87.66 g 23-3 (MW 320) with 32.34 g 99.6% $H_2SO_4$; 115.54 g of the ES mix neutralized with 50% NaOH (38.4 g) to pH 7–9 in 800 g distilled water; qs with distilled water to 1000 g

10% 3/7 ES (75/25)

a 120 g 58% converted ES prepared by mixing 67.29 g 23-3 and 22.44 g 26-7 with 30.27 g 99.6% $H_2SO_4$; 114.4 g of the ES mix neutralized with 50% NaOH (35.58 g) to pH 7–9 in 800 g distilled water; qs with distilled water to 1000 g

10% 3/7 ES (50/50)

a 120 g 58% converted ES prepared by mixing 45.95 g 23-3 and 45.95 g 26-7 with 28.10 g 99.6% $H_2SO_4$; 113.23 g of the ES mix neutralized with 50% NaOH (32.69 g) to pH 7–9 in 800 g distilled water; qs with distilled water to 1000 g

10% 3/7 ES (25/75)

a 120 g 58% converted ES prepared by mixing 23.55 g 23-3 and 70.64 g 26-7 with 25.81 g 99.6% $H_2SO_4$; 112.02 g of the ES neutralized mix with 50% NaOH (29.723 g) to pH 7–9 in 800 g distilled water; qs with distilled water to 1000 g

10% 26-7 a 120 g 58% converted ES prepared by mixing 96.58 g 26-7 (MW 487) with 23.42 g 99.6% $H_2SO_4$; 110.79 g of ES mix neutralized with 50% NaOH (26.66 g) to pH 7–9 in 800 g distilled water; qs with distilled water to 1000 g

| | LAE solution (g) | LAS solution (g) | AES solution (g) | Ash solution (g) |
|---|---|---|---|---|
| A (ctr1) | 155.2 | 34.5 | 17.3 | 30.0 |
| B | — | — | — | 30.0 |
| C | — | — | — | 30.0 |
| D | — | — | — | 30.0 |
| E | — | — | — | 30.0 |
| F | — | — | — | 30.0 |

| | 3/7 ES (100/0) (g) | 3/7 ES (75/25) (g) | 3/7 ES (50/50) (g) | 3/7 ES (75/25) (g) | 3/7 ES (0/100) (g) |
|---|---|---|---|---|---|
| A (ctr1) | — | — | — | — | — |
| B | 207.0 | — | — | — | — |
| D | — | 207.0 | — | — | — |
| D | — | — | 207.0 | — | — |
| E | — | — | — | 207.0 | — |
| F | — | — | — | — | 207.0 |

Tests A–F deliver 20.7 g of surfactant each.
LAE = Linear alcohol ethoxylate
LAS = Linear alkylbenzene sulfonate
AES = Alcohol ether sulfate The comparative test data in Table IV demonstrate a trend of increased detergency performance in present invention detergent formulations as the relative ratio of 3 ethoxy molar to 7 ethoxy molar in sulfated mixtures is increased under the conditions tested.

Present invention liquid detergent formulations perform well in textile stain and soil cleaning tests in comparison with control liquid detergent formulation.

Present invention liquid detergent formulations have an advantageous combination of stability and detergency properties.

TABLE IV

STANDARD WASH TEST RESULTS AT 95° F./100 PPM IN PRESENCE OF SODA ASH

| PERCENT STAIN/SOIL REMOVAL | | A CONTROL | B 3/7 ES (100/0) |
|---|---|---|---|
| | | LAE 15.5 g<br>AES 1.7 g<br>LAS 3.5 g<br>ASH 3.O g | LAE 7.3 g<br>AES 13.4 g<br>ASH 3.O g |
| STAINS | | | |
| Grass | Cotton | 46.4 | 55.0 |
| Coffee | Cotton | 58.1 | 64.1 |
| Beef Gravy | Cotton | 82.0 | 84.8 |
| Ketchup | Cotton | 92.9 | 93.4 |
| Makeup | Cotton | 35.6 | 34.3 |
| EMPA 116 | Cotton | 36.3 | 36.9 |
| EMPA 117 | Poly/cotton | 27.9 | 35.6 |

TABLE IV-continued

STANDARD WASH TEST RESULTS AT 95° F./100 PPM IN PRESENCE OF SODA ASH

| PERCENT STAIN/SOIL REMOVAL | | C 3/7 ES (75/25) | D 3/7 ES (50/50) |
|---|---|---|---|
| | | LAE 7.4 g<br>AES 13.3 g<br>ASH 3.0 g | LAE 7.5 g<br>AES 13.2 g<br>ASH 3.0 g |
| STAINS | | | |
| Grass | Cotton | 50.8 | 45.4 |
| Coffee | Cotton | 63.9 | 63.9 |
| Beef Gravy | Cotton | 84.7 | 81.7 |
| Ketchup | Cotton | 93.5 | 91.8 |
| Makeup | Cotton | 33.7 | 30.8 |
| EMPA 116 | Cotton | 36.8 | 35.9 |
| EMPA 117 | Poly/cotton | 34.1 | 30.1 |

EMPA 116 = Blood, milk and carbon black on cotton.
EMPA 117 = Blood, milk and carbon black on poly/cotton.

| PERCENT STAIN/SOIL REMOVAL | | E 3/7 ES (25/75) | F 3/7 ES (0/100) |
|---|---|---|---|
| | | LAE 7.6 g<br>AES 13.1 g<br>ASH 3.0 g | LAE 7.8 g<br>AES 12.9 g<br>ASH 3.0 g |
| STAINS | | | |
| Grass | Cotton | 41.7 | 35.2 |
| Coffee | Cotton | 61.7 | 62.5 |
| Beef Gravy | Cotton | 80.1 | 78.8 |
| Ketchup | Cotton | 90.2 | 90.3 |
| Makeup | Cotton | 32.5 | 31.4 |
| EMPA 116 | Cotton | 35.0 | 34.3 |
| EMPA 117 | Poly/cotton | 28.3 | 28.5 |

| PERCENT STAIN/SOIL REMOVAL | | LSD |
|---|---|---|
| STAINS | | |
| Grass | Cotton | 2.2 |
| Coffee | Cotton | 2.3 |
| Beef Gravy | Cotton | 1.5 |
| Ketchup | Cotton | 2.1 |
| Makeup | Cotton | 3.2 |
| EMPA 116 | Cotton | 2.6 |
| EMPA 117 | Poly/cotton | 2.3 |

LSD = least statistical difference.

| PERCENT STAIN/SOIL REMOVAL | | A CONTROL | B 3/7 ES (100/0) |
|---|---|---|---|
| | | LAE 15.5 g<br>AES 1.7 g<br>LAS 3.5 g<br>ASH 3.0 g | LAE 7.3 g<br>AES 13.4 g<br>ASH 3.0 g |
| SOILS | | | |
| Sebum | Cotton | 47.9 | 48.7 |
| Standard | Cotton | 23.5 | 27.0 |
| EMPA 101 | Cotton | 26.2 | 26.4 |
| Clay | Cotton | 51.6 | 52.2 |
| Sebum | Poly/cotton | 57.9 | 55.4 |
| EMPA 104 | Poly/cotton | 28.2 | 26.5 |
| Clay | Poly/cotton | 70.5 | 66.6 |

TABLE IV-continued

STANDARD WASH TEST RESULTS AT 95° F./100 PPM IN PRESENCE OF SODA ASH

| PERCENT STAIN/SOIL REMOVAL | | C 3/7 ES (75/25) | D 3/7 ES (50/50) |
|---|---|---|---|
| | | LAE 7.4 g<br>AES 13.3 g<br>ASH 3.0 g | LAE 7.5 g<br>AES 13.2 g<br>ASH 3.0 g |
| SOILS | | | |
| Sebum | Cotton | 49.5 | 48.4 |
| Standard | Cotton | 24.6 | 23.8 |
| EMPA 101 | Cotton | 27.3 | 25.4 |
| Clay | Cotton | 52.7 | 52.3 |
| Sebum | Poly/cotton | 57.4 | 57.3 |
| EMPA 104 | Poly/cotton | 26.7 | 24.2 |
| Clay | Poly/cotton | 68.0 | 66.9 |

EMPA 101 = Carbon black and olive oil on cotton.
EMPA 104 = Carbon black and olive oil on poly/cotton.

| PERCENT STAIN/SOIL REMOVAL | | E 3/7 ES (25/75) | F 3/7 ES (0/100) |
|---|---|---|---|
| | | LAE 7.6 g<br>AES 13.1 g<br>ASH 3.0 g | LAE 7.8 g<br>AES 12.9 g<br>ASH 3.0 g |
| SOILS | | | |
| Sebum | Cotton | 48.5 | 45.4 |
| Standard | Cotton | 22.0 | 20.4 |
| EMPA 101 | Cotton | 26.2 | 23.7 |
| Clay | Cotton | 51.8 | 51.6 |
| Sebum | Poly/cotton | 57.0 | 56.2 |
| EMPA 104 | Poly/cotton | 23.2 | 22.9 |
| Clay | Poly/cotton | 68.5 | 68.6 |
| PERCENT STAIN/SOIL REMOVAL | | | LSD |
| SOILS | | | |
| Sebum | Cotton | | 3.3 |
| Standard | Cotton | | 4.6 |
| EMPA 101 | Cotton | | 2.9 |
| Clay | Cotton | | 2.9 |
| Sebum | Poly/cotton | | 1.6 |
| EMPA 104 | Poly/cotton | | 2.5 |
| Clay | Poly/cotton | | 4.3 |

| PERCENT STAIN/SOIL REMOVAL | | A CONTROL | B 3/7 ES (100/0) |
|---|---|---|---|
| | | LAE 15.5 g<br>AES 1.7 g<br>LAS 3.5 g<br>ASH 3.0 g | LAE 7.3 g<br>AES 13.4 g<br>ASH 3.O g |
| WHITENESS INDEX | | | |
| delta B | | −0.1 | −0.1 |
| delta WIE | | 0.5 | 0.7 |
| pH 1 min. | | 9.1 | 9.2 |
| 10 min. | | 9.1 | 9.1 |

| PERCENT STAIN/SOIL REMOVAL | | C 3/7 ES (75/25) | D 3/7 ES (50/50) |
|---|---|---|---|
| | | LAE 7.4 g<br>AES 13.3 g<br>ASH 3.0 g | LAE 7.5 g<br>AES 13.2 g<br>ASH 3.0 g |
| WHITENESS INDEX | | | |
| delta B | | −0.2 | −0.2 |
| delta WIE | | 0.9 | 1.1 |
| pH 1 min. | | 9.2 | 9.2 |
| 10 min. | | 9.1 | 9.1 |

TABLE IV-continued

STANDARD WASH TEST RESULTS AT 95° F./100 PPM IN PRESENCE OF SODA ASH

| PERCENT STAIN/SOIL REMOVAL | | E 3/7 ES (25/75) | F 3/7 ES (0/100) |
|---|---|---|---|
| | | LAE 7.6 g<br>AES 13.1 g<br>ASH 3.0 g | LAE 7.8 g<br>AES 12.9 g<br>ASH 3.0 g |
| WHITENESS INDEX | | | |
| delta B | | −0.1 | −0.2 |
| delta WIE | | 0.7 | 1.2 |
| pH 1 min. | | 9.2 | 9.2 |
| 10 min. | | 9.1 | 9.1 |
| PERCENT STAIN/SOIL REMOVAL | | | LSD |
| WHITENESS INDEX | | | |
| delta B | | | 0.1 |
| delta WIE | | | 0.4 |
| pH 1 min. | | | |
| 10 min. | | | |

| PERCENT STAIN/SOIL REMOVAL | | A CONTROL | B 3/7 ES (100/0) |
|---|---|---|---|
| | | LAE 15.5 g<br>AES 1.7 g<br>LAS 3.5 g<br>ASH 3.0 g | LAE 7.3 g<br>AES 13.4 g<br>ASH 3.0 g |
| OVERALL STAIN REMOVAL | | 54.2 | 57.7 |
| OVERALL SOIL REMOVAL | | 43.7 | 43.2 |

| PERCENT STAIN/SOIL REMOVAL | | C 3/7 ES (75/25) | D 3/7 ES (50/50) |
|---|---|---|---|
| | | LAE 7.4 g<br>AES 13.3 g<br>ASH 3.0 g | LAE 7.5 g<br>AES 13.2 g<br>ASH 3.0 g |
| OVERALL STAIN REMOVAL | | 56.8 | 54.2 |
| OVERALL SOIL REMOVAL | | 43.7 | 42.6 |

| PERCENT STAIN/SOIL REMOVAL | | E 3/7 ES (25/75) | F 3/7 ES (0/100) |
|---|---|---|---|
| | | LAE 7.6 g<br>AES 13.1 g<br>ASH 3.0 g | LAE 7.8 g<br>AES 12.9 g<br>ASH 3.0 g |
| OVERALL STAIN REMOVAL | | 52.8 | 51.6 |
| OVERALL SOIL REMOVAL | | 42.5 | 41.3 |
| PERCENT STAIN/SOIL REMOVAL | | | LSD |
| OVERALL STAIN REMOVAL | | | 2.3 |
| OVERALL SOIL REMOVAL | | | 3.2 |

What is claimed is:

1. A liquid laundry detergent product which is a clear, homogeneous aqueous solution that is stable under freeze/thaw and high/low temperature conditions and which provides high detergency, said product comprising:

(A) between about 0.5–12 weight percent of sodium carbonate detergent builder ingredient;

(B) between about 5–35 weight percent of a detergent active ingredient comprising a partially sulfated and neutralized anionic/nonionic surfactant blend containing:

(a) a first partially sulfated and neutralized anionic/nonionic surfactant component comprising:

(i) an anionic salt compound corresponding to the formula:

$R—O—(CH_2CH_2O)_3—SO_3M$ where R is a $C_{10}$–$C_{16}$ alkyl group, and M is an alkali metal or ammonium cation; and (ii) a nonionic compound corresponding to the formula:

$R—O—(CH_2CH_2O)_3—H$ where R is a $C_{10}$–$C_{16}$ alkyl group;

(b) a second partially sulfated and neutralized anionic/nonionic surfactant component comprising:

(i) an anionic salt compound corresponding to the formula:

$R—O—(CH_2CH_2O)_7—SO_3M$ where R is a $C_{10}$–$C_{16}$ alkyl group, and M is an alkali metal or ammonium cation; and (ii) a nonionic compound corresponding to the formula:

$R—O—(CH_2CH_2O)_7—H$ where R is a $C_{10}$–$C_{16}$ alkyl group; and (C) water and wherein component (B)(a) comprises from about 30% to about 80% by weight of the (B)(a)(I) anionic salt compound and from about 20% to about 70% by weight of the (B)(a)(ii) nonionic compound.

2. A laundry detergent product in accordance with claim 1 wherein the detergent builder ingredient comprises a mixture of sodium bicarbonate and sodium carbonate.

3. A laundry detergent product in accordance with claim 1 wherein the detergent builder ingredient comprises a mixture of sodium sesquicarbonate and sodium carbonate.

4. A laundry detergent product in accordance with claim 1 which contains between about 1–15 weight percent of alkali metal silicate corrosion inhibitor.

5. A product according to claim 1, wherein the first partially sulfated and neutralized anionic/nonionic surfactant component (B)(a) comprises about 58% by weight of the (B)(a)(i) anionic salt compound and about 42% by weight of the (B)(a)(ii) nonionic compound.

6. A product according to claim 1, wherein the second partially sulfated and neutralized anionic/nonionic surfactant component (B)(b) comprises from about 30% to about 80% by weight of the (B)(b)(i) anionic salt compound and from about 20% to about 70% by weight of the (B)(b)(ii) nonionic compound.

7. A product according to claim 1, wherein the second partially sulfated and neutralized anionic/nonionic surfactant component (B)(b) comprises about 58% by weight of the (B)(b)(i) anionic salt compound and about 42% by weight of the (B)(b)(ii) nonionic compound.

8. A product according to claim 1, wherein the partially sulfated and neutralized anionic/nonionic surfactant blend (B) comprises about 50% by weight of the first partially sulfated and neutralized anionic/nonionic surfactant component (B)(a) and about 50% by weight of the second partially sulfated and neutralized anionic/nonionic surfactant component (B)(b).

9. A product according to claim 1, wherein the product is free of hydrotropes.

10. A detergent active composition which, when combined with water and a sodium carbonate detergent builder ingredient so as to form an aqueous liquid laundry detergent product comprising from about 5 to about 35 weight percent of the detergent active composition and from about 0.5 to 12 weight percent of the sodium carbonate detergent builder ingredient, is capable of providing such detergent product with clarity, homogeneity, stability under freeze/thaw and high/low temperature conditions and high detergency properties, said detergent active composition comprising a partially sulfated and neutralized anionic/nonionic surfactant blend containing:

(a) a first partially sulfated and neutralized anionic/nonionic surfactant component comprising:

(i) an anionic salt compound corresponding to the formula:

$R—O—(CH_2CH_2O)_3—SO_3M$ where R is a $C_{10}$–$C_{16}$ alkyl group, and M is an alkali metal or ammonium cation; and (ii) a nonionic compound corresponding to the formula:

$R—O—(CH_2CH_2O)_3—H$ where R is a $C_{10}$–$C_{16}$ alkyl group; and (b) a second partially sulfated and neutralized anionic/nonionic surfactant component comprising:

(i) an anionic salt compound corresponding to the formula:

$R—O—(CH_2CH_2O)_7—SO_3M$ where R is a $C_{10}$–$C_{16}$ alkyl group, and M is an alkali metal or ammonium cation;

(ii) a nonionic compound corresponding to the formula:

$R—O—(CH_2CH_2O)_7—H$ where R is a $C_{10}$–$C_{16}$ alkyl group and wherein component (a) comprises from about 30% to about 80% by weight of the a(i) anionic salt compound and from about 20% to about 70% by weight of the (a)(ii) nonionic compound.

11. A composition according to claim 10, wherein the first partially sulfated and neutralized anionic/nonionic surfactant component (a) comprises about 58% by weight of the (a)(i) anionic salt compound and about 42% by weight of the (a)(ii) nonionic compound.

12. A composition according to claim 10, wherein the second partially sulfated and neutralized anionic/nonionic surfactant component (b) comprises from about 30% to about 80% by weight of the (b)(i) anionic salt compound and from about 20% to about 70% by weight of the (b)(ii) nonionic compound.

13. A composition according to claim 10, wherein the second partially sulfated and neutralized anionic/nonionic surfactant component (b) comprises about 58% by weight of the (b)(i) anionic salt compound and about 42% by weight of the (b)(ii) nonionic compound.

14. A composition according to claim 10, wherein the partially sulfated and neutralized anionic/nonionic surfactant blend comprises about 50% by weight of the first partially sulfated and neutralized anionic/nonionic surfactant component and about 50% by weight of the second partially sulfated and neutralized anionic/nonionic surfactant component.

15. A composition according to claim 10, wherein the surfactant blend is capable of providing said liquid laundry detergent product with said clarity and stability in the absence of a hydrotrope.

* * * * *